United States Patent [19]

Allen et al.

[11] Patent Number: 4,930,430

[45] Date of Patent: Jun. 5, 1990

[54] BURNERS

[75] Inventors: Jeffrey W. Allen, Tollerton; Peter R. Beal, Bramcote Hills; Dennis R. Whinfrey, Mickleover, all of England

[73] Assignee: Northern Engineering Industries PLC, Newcastle Upon Tyne, England

[21] Appl. No.: 317,743

[22] Filed: Mar. 2, 1989

[30] Foreign Application Priority Data

Mar. 4, 1988 [GB] United Kingdom ..... 8805208
Dec. 13, 1988 [GB] United Kingdom ..... 8829061

[51] Int. Cl.[5] ..... F23D 1/02

[52] U.S. Cl. ..... 110/264; 110/263; 110/347; 431/285; 431/185

[58] Field of Search ..... 110/263, 264, 265, 347; 431/185, 284, 285

[56] References Cited

U.S. PATENT DOCUMENTS

| | | | |
|---|---|---|---|
| 1,828,465 | 10/1931 | Haynes . | |
| 2,216,508 | 10/1940 | Zink | 431/185 |
| 2,325,442 | 7/1943 | Vroom | 431/185 |
| 2,335,188 | 11/1943 | Kennedy | 431/185 |
| 3,934,522 | 1/1976 | Booker . | |
| 4,223,615 | 9/1980 | Breen et al. | 110/264 |
| 4,333,405 | 6/1982 | Michelfelder et al. | 110/265 |
| 4,457,241 | 7/1984 | Itse et al. | 110/264 |
| 4,555,994 | 12/1985 | Voigt et al. | 110/264 |
| 4,688,496 | 8/1987 | Schreter | 110/347 |
| 4,702,180 | 10/1987 | Kiga | 110/264 |
| 4,807,541 | 2/1989 | Masai et al. | 110/264 |

FOREIGN PATENT DOCUMENTS

| | | |
|---|---|---|
| 160146 | 6/1985 | European Pat. Off. . |
| 436812 | 9/1926 | Fed. Rep. of Germany . |
| 219076 | 7/1924 | United Kingdom . |
| 228507 | 4/1925 | United Kingdom . |
| 265168 | 6/1927 | United Kingdom . |
| 303226 | 1/1929 | United Kingdom . |
| 377474 | 7/1932 | United Kingdom . |
| 2094969 | 9/1982 | United Kingdom . |
| 2108650 | 5/1983 | United Kingdom . |
| 2138120 | 10/1984 | United Kingdom . |

*Primary Examiner*—Edward G. Favors
*Assistant Examiner*—Denise L. Ferensic
*Attorney, Agent, or Firm*—Dainow & Jacobs Rosen

[57] ABSTRACT

A pulverized fuel and air mixture is burnt in conditions giving relatively low $NO_x$ emissions by using a burner which has concentric passages for a primary air-fuel mixture and secondary and ternary air flows respectively. In the passage for the primary air-fuel mixture guide elements are provided at angularly spaced positions. The elements are arranged to deflect the flow in the passage and so produce regions of high fuel concentration. Downstream of the guide elements and adjacent the outlet of the passage flow disturbing members are provided in angularly spaced positions to modify the flow pattern of the air-fuel mixture at the passage outlet. The members assist stabilization of the flame front at the burner outlet and complement the action of the guide elements in promoting combustion conditions that lead to low $NO_x$ emissions.

13 Claims, 2 Drawing Sheets

BURNERS

BACKGROUND OF THE INVENTION

This invention relates to burners and is particularly concerned with burners which yield relatively low levels of nitrogen oxide ($NO_x$) in their combustion products.

Nitrogen oxides ($NO_x$) emitted from boiler and furnace plants, for example, have attracted considerable attention owing to the detrimental affect they have on the environment. Pulverised fuel, eg. coal or other like carbonaceous fuel, burners used in power generating stations are a major source of $NO_x$. In such burners, $NO_x$, emissions are generated both from atmospheric nitrogen (in dependence upon flame temperature) and from nitrogen fixed in the fuel (in dependence upon the amount of oxygen available during combustion).

An example of a pulverised fuel burner intended to reduce $NO_x$ emissions can be found in GB 2094969, where it is proposed to inject a swirling flow of air and fuel into supplementary air flow in order to combust the fuel in stages in sub-stoichiometric conditions. Similarly, in EP 160146 turbulence is created in the mixture of primary air and fuel by providing the outlet of the supply tube for that mixture with a flange of L-shaped cross-section, in effect a sharp edged nozzle, before combusting the fuel with secondary and tertiary air flows. More generally, known techniques for reducing the formation of $NO_x$ by pulverised fuel burners can be exemplified as follows:

by controlling the admission of air at the upstream end, relative to fuel/air flow, of the flame to avoid high flame temperatures thereby minimising the formation of $NO_x$ from atmospheric nitrogen;

by forming a fuel-rich region at the upstream end of the flame to release fuel nitrogen and other volatiles in the presence of sub-stoichiometric quantities of oxygen whereby the formation of $NO_x$ and of high temperature regions through the combustion of volatiles are minimised;

by maintaining the fuel-rich region so that any $NO_x$ formed in the early part of the combustion process can react with the fuel in a reducing environment to revert to nitrogen and carbon monoxide.

One way of establishing these conditions is to form a curtain of flame immediately around the edge of the fuel/air jet emerging from the burner. The purpose of this primary combustion stage is to create a flame in substoichiometric conditions that will provide heat to the fuel to release the fuel nitrogen and other volatiles. If secondary and tertiary air can then be added smoothly to the flow of fuel/primary air and volatiles without undue turbulence (which would cause high temperatures) it should be possible to achieve complete mixing and combustion within a volume similar to that occupied by a conventional high-turbulence flame.

The main difficulties in achieving these objectives are to ensure that a stable flame can be maintained at the fuel/primary air outlet from the burner, and then ensuring smooth mixing of fuel and air avoiding, on the one hand, excessive turbulence and hence high temperatures and $NO_x$ and, on the other hand, mixing that is delayed so long that it results in incomplete combustion of the fuel.

SUMMARY OF THE INVENTION

According to the present invention, there is provided a burner for the combustion of pulverised fuel in an airstream, comprising means to generate a flow of the air-fuel mixture along a passage, a plurality of guide elements being located in the passage in positions angularly spaced about a central axis of the passage, said elements extending along the passage at an oblique angle to the flow incident upon them and, spaced downstream from said elements, at or adjacent an outlet end of the passage, a plurality of flow-disturbing members being located in the passage in positions angularly spaced about said central axis, said members being arranged to modify the flow pattern of the air-fuel mixture at the passage outlet.

It has been found that it is advantageous to locate at least one of the flow-disturbing members substantially coincident with the path of the flow from a guide element, and it is possible to have a respective member so located in relation to each of the guide elements. Further flow-disturbing members can be located at intermediate positions between the paths of the flows from adjacent pairs of guide elements.

In one specific arrangement, there are four guide elements pitched at 90 degree intervals about the axis of the passage and ten flow-disturbing members are spaced downstream from these, pitched at 36 degree intervals about said axis, with one diametrically opposite pair of the members substantially coincident with the flow paths from a diametrically opposite pair of the guide elements. In another arrangement, the passage for the air-fuel mixture, which is preferably annular, has means at its inlet for imparting a swirling pattern to the flow therethrough, in which case the guide elements can extend parallel to the central axis of the passage. Upstream of the elements, means on the outer wall of the passage may be provided to counteract the tendency of the fuel particles to concentrate towards that outer wall and form concentrated streams or ropes of fuel, said means thereby improving the mixing of the fuel and air aproaching the guide elements.

Preferably, in its outlet region, said passage is surrounded by a pair of concentric auxiliary passages to supply supplementary air to the combusiton process. Each of said auxiliary passages may contain flow-guiding members, so arranged that at their adjacent outlets the flow from each passage emerges in a swirling pattern relative to the flow from the adjoining passage or passages. For example, if the flow from the air-fuel passage emerges parallel to the central axis, that in the adjoining auxiliary passage is arranged to emerge in a swirling pattern, preferably with a helix angle of at least 45 degrees to the axis, while the air from the outer auxiliary passage can also emerge flowing parallel to the axis.

In their preferred form, the flow-disturbing members have a profile that thickens from a relatively fine leading edge and may terminate in a bluff trailing edge.

By way of example only, the invention will now be described with reference to the accompanying drawings.

DESCRIPTION OF THE PREFERRED EMBODIMENTS

Figure 1:
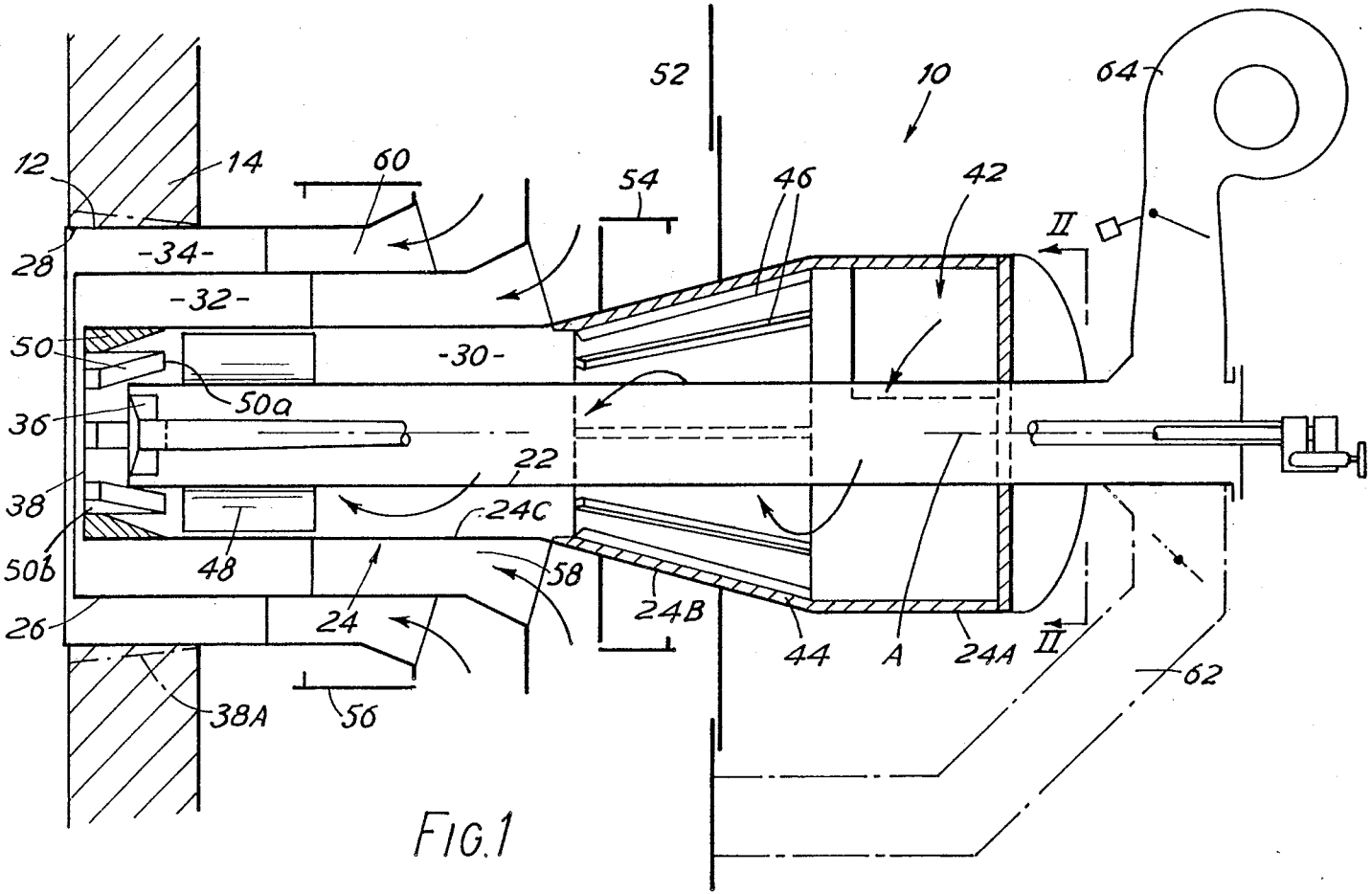
FIG. 1 is a schematic longitudinal cross-section through the burner constructed in accordance with the invention.
Figure 2:
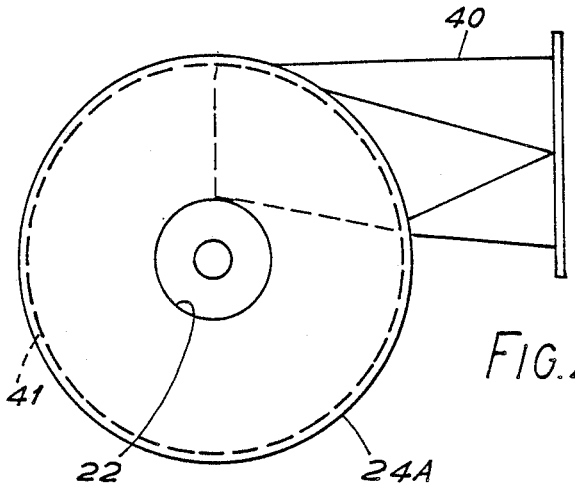
FIG. 2 is a section taken on line II—II in FIG. 1.
Figure 3:
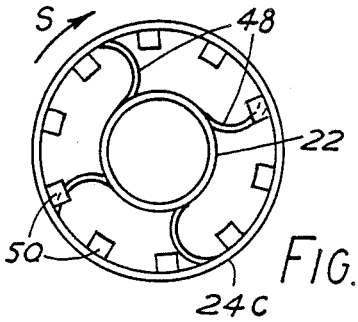
FIG. 3 is an end view from the outlet end of the burner illustrating the relative dispositions of the guide elements and the flow-disturbing members.

Referring to FIGS. 1 to 3, a pulverised fuel burner 10 is mounted in an aperture 12 in wall 14 of a furnace which is not otherwise shown. It is to be understood that the burner fires a fuel into a combustion chamber which, depending upon the application, may be lined with heat exchange tubes in a known manner. It will also be understood that the burner 10 may be one of several mounted in the furnace wall to achieve a desired combustion pattern.

The burner 10 extends along a central axis A and comprises co-axial tubes 22,24,26,28 which define a main annular passage 30 for a mixture of pulverised fuel and air and inner and outer auxiliary passages 32,34 for additional combustion air. The interior of the tube 22 itself forms a passage for an oil burner 36 as an ignition system for pulverised fuel or for heat input duties for the furnace. The outermost tube 28 is shown parallel to the other tubes at outlet end 38 of the burner, but it can be flared as shown in ghost outline at 38A.

The tube 24 has a relatively large diameter inlet section 24A and a tapering intermediate section 24B connects this with a smaller diameter outlet portion 24C terminating at the outlet end 38. A duct 40 (see FIG. 2) joins the inlet section 24A tangentially, in register with an inlet opening 42 in the tube. The duct introduces a swirling flow of primary combustion air, in which pulverised fuel is suspended, that passes along the passage 30 in a spiralling stream as indicated by the arrows in FIG. 1. A wear resistant liner 44 is fitted into the inlet and intermediate sections 24A,24B downstream of the inlet opening 42, the liner having integral ribs 46 extending axially of the passage 30 to promote remixing of pulverised fuel particles that tend to be forced radially outwards in the swirling flow.

A series of four guide elements 48 acting as fuel-flow redistributors are mounted at equal angular spacings about the central axis A of the annular passage in the outlet section 24C of the passage. The guide elements are blade-like members extending parallel to the central axis of the passage and thus lying at an oblique angle to the spiralling air-fuel flow. In this first example, the guide elements have a curved cross-section with the concave faces providing impingement faces for particles swirling into them. By interrupting the swirl of the solid fuel particles, the elements produce concentrations of the particles on their concave faces. These particles remain entrained in the air flow, however, with the result that a series of regions with a high fuel-air ratio are formed in the flow downstream of the elements 48.

Flow-disturbing members 50 of a wear-resistant material are located at the exit end of the passage, spaced from the elements 48. They take the form of wedges, of increasing radial depth from their leading edges 50*a* in the direction of flow, and with bluff downstream faces 50*b*. The leading edges of the members lie against the outer wall of the passage 30 and their downstream faces extend over a part of the radial depth of the passage. The members 50 have the effect of stabilising the flame onto the exit end of the burner. As indicated in FIG. 3, there are ten equispaced flow-disturbing members, so arranged that two diametrically opposite members are directly in the wake of two of the guide elements 48 in the direction of flow past the guide elements.

The outer annular passages 32,34 supply secondary and tertiary combustion air from wind box 52, the flow from which into the passages 32,34 is controlled by sliding annular dampers 54,56. Respective sets of flow-directing members 58,60 are located in the passages 32,34. The members 58 in the passage 32 impart a spiral flow pattern to the airflow there; in this embodiment the spiral angle subtended to the central axis 12 is at least 45 degrees. The flow-directing members 60 impart an axial flow pattern to the air flow in the passage 34.

Combustion air can be supplied to the oil burner 36 through a duct 62 connected to the wind box 52. Alternatively, a fan 64 can be employed. It will be appreciated that other ignition systems can be used.

The configuration of the guide elements and the flow-disturbing members 50 can be modified in many ways and some examples are illustrated in FIGS. 4–7 where, as in FIG. 3, the arrow S indicates the direction of swirl of the flow in the passage 30. In all these examples, the guide elements are taken to extend parallel to the central axis 12, although that is dependent upon the existence and extent of swirl in the flow of air and fuel onto them.

Figure 4:
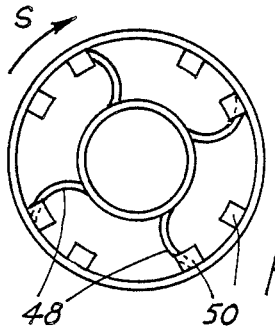
FIGS. 4–7 are end views similar to FIG. 3 illustrating alternative configurations of the guide elements and the flow-disturbing members.

FIG. 4 shows an arrangement with the same configuration of guide elements 48 as in the first example, but now with eight flow-disturbing members 50, disposed in pairs. In each pair of members 50, one is disposed directly behind a respective guide element, in the wake of the flow leaving the element, while the other is spaced asymmetrically from its neighbours, as seen in the direction of swirl S. Said other member of the pair is circumferentially set somewhat closer to the guide element whose impingement face is turned towards it than that element whose impingement face is turned away from it.

Figure 5:
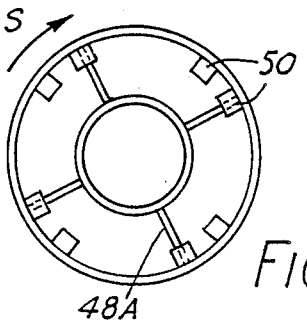
Figure 6:
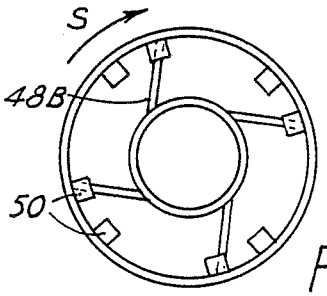
Figure 7:
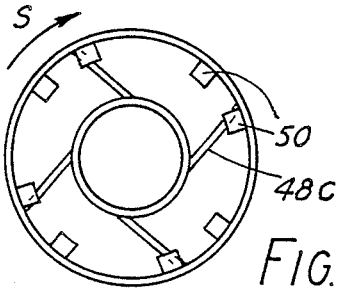

In FIG. 5, the arrangement of flow-disturbing members shown in FIG. 4 is retained, but the guide elements 48A are now flat plates in radial axial planes to the central axis 12. Flat plate guide elements 48B,48C are also shown in FIGS. 6 and 7 respectively, where the arrangement of the flow-disturbing members is unchanged. In FIG. 6 the guide elements 48B are inclined in the direction of swirl from their radially inner edges to their outer edges. In FIG. 7 the elements 48C are inclined away from the direction of swirl from their radially inner edges to their outer edges. It is to be understood that many other modifications fall within the scope of the invention with regard not only to the shape of the guide elements and the flow-disturbing members, but also their numbers and relative dispositions.

Although the mechanisms by which the invention is able to achieve a reduction of $NO_x$ emissions remain to be precisely charted, it is believed that the low rate of $NO_x$ formation is dependent on the provision of guide elements to create fuel-rich regions that inhibit $NO_x$ formation in the first instance. Such fuel-rich regions can lead to instability of the flame front, however. The flow-disturbing members disposed downstream seem to complement the effect of these guide elements and appear to interact with the flow to promote a spectrum of fuel-air mixture strengths in the wake of the flow from the members. It is possible that there are, therefore, fuel-deficient zones immediately downstream of the burner tube outlet, where the fuel is more readily ignited owing to the relative excess of oxygen, so stabilising the flame front onto the burner outlet.

An additional benefit of the flow-deflecting members is that they seem to promote re-circulation and mixing to assist complete combustion of the fuel without affecting the enhanced stability of the flame front. A feature of the spaced wedge-form of the flow-deflecting members in the examples is that they appear to resist the build-up of combustion deposits in use, and their effectiveness is correspondingly extended.

We claim:

1. A burner for the combustion of pulverised fuel in an air stream, comprising a passage having a central axis, an inlet for admitting a flow of said fuel mixed in the air stream and an outlet axially spaced from said inlet at which outlet primary combustion of the air-fuel mixture takes place, means extending to adjacent said outlet means for supplying supplementary air for combustion with the products of said primary combustion, a plurality of individual guide elements located in the passage in positions angularly spaced about the central axis of the passage, means upstream of the guide elements to impart to the flow in the passage a rotary swirl about said control axis, said guide elements projecting substantially the full radial depth of the passage and extending along the passage at an oblique angle to the flow of the air-fuel mixture incident upon them whereby to at least reduce the rotary swirl of the flow in the passage, at or adjacent the outlet end of the passage a plurality of flow-distributing members located in the passage in positions angularly spaced about said central axis and spaced downstream from said guide elements, said flow-disturbing members being arranged to modify the flow pattern of the air-fuel mixture at the passage outlet.

2. A burner according to claim 1 wherein at least one of the flow-disturbing members is substantially coincident with the path of the flow from a guide element.

3. A burner according to claim 1 wherein the flow-disturbing members have a bluff trailing edge.

4. A burner according to claim 1 wherein the flow-disturbing members occupy only a portion of the depth of the passage radially of said central axis.

5. A burner according to claim 4 wherein the passage has an outer peripheral wall from which the flow-disturbing members project inwardly

6. A burner according to claim 1 wherein means are provided upstream of the guide elements to impart to the flow in said passage a rotary swirl about the central axis of said passage.

7. A burner according to claim 1 wherein the passage has an outer peripheral wall upstream of the guide elements whereat means are provided for promoting the mixing fuel particles in the flow adjacent said wall.

8. A burner according to claim 1 wherein said passage is surrounded at its outlet region by a pair of concentric auxiliary passages for the supplementary air supply to the combustion process.

9. A burner according to claim 8 wherein, said auxiliary passages and said mixture flow passage have mutually adjacent outlets, means for directing the flow through each said passage for causing the flow from each passage to emerge in a direction having a relative rotary motion with respect to the flow from the adjoining passage or passages.

10. A burner for the combustion of pulverized fuel in an air stream, comprising a passage having a central axis, an inlet for admitting a flow of said fuel mixed in the air stream and an outlet axially spaced from said inlet at which outlet primary combustion of the air-fuel mixture takes place, means extending to adjacent said outlet means for supplying supplementary air for combustion with the products of said primary combustion, a plurality of guide elements located in the passage in positions angularly spaced about the central axis of the passage, said guide elements extending along the passage at an oblique angle to the flow of the air-fuel mixture incident upon them, at or adjacent the outlet end of the passage a plurality of flow-distributing members located in the passage in positions angularly spaced about said central axis and spaced downstream from said guide elements, a respective said flow-disturbing member being peripherally located substantially coincident with the path of flow from each of the guide elements, said flow-disturbing members being arranged to modify the flow pattern of the air-fuel mixture at the passage outlet.

11. A burner for the combustion of pulverised fuel in an air stream, comprising a passage having a central axis, an inlet for admitting a flow of said fuel mixed in the air stream and an outlet axially spaced from said inlet at which outlet primary combustion of the air-fuel mixture takes place, means extending to adjacent said outlet means for supplying supplementary air for combustion with the products of said primary combustion, a series of four guide elements located in the passage in positions equally angularly spaced about the central axis of the passage, said guide elements extending along the passage at an oblique angle to the flow of the air-fuel mixture incident upon them, at or adjacent the outlet end of the passage a series of ten flow-disturbing members located in the passage in positions equally angularly spaced about said central axis and spaced downstream from said guide elements, one diametrically opposite pair of the flow-disturbing members being located substantially coincident with the flow paths from a diametrically opposite pair of the guide elements, said flow-disturbing members being arranged to modify the flow pattern of the air-fuel mixture at the passage outlet.

12. A burner for the combustion of pulverised fuel in an air stream, comprising a passage having a central axis, an inlet for admitting a flow of said fuel mixed in the air stream and an outlet axially spaced from said inlet at which outlet primary combustion of the air-fuel mixture takes place, means extending to adjacent said outlet means for supplying supplementary air for combustion with the products of said primary combustion, a plurality of guide elements located in the passage in positions angularly spaced about the central axis of the passage, said guide elements extending along the passage at an oblique angle to the flow of the air-fuel mixture incident upon them, at or adjacent the outlet end of the passage a plurality of flow-disturbing members located in the passage spaced downstream from said guide elements in positions angularly spaced about said central axis at peripheral locations that include intermediate positions between the paths of the flows from adjacent pairs of guide members, said flow-disturbing members being arranged to modify the flow pattern of the air-fuel mixture at the passage outlet.

13. A burner for the combustion of pulverised fuel in an air stream, comprising a passage having a central axis, an inlet for admitting a flow of said fuel mixed in the air stream and an outlet axially spaced from said inlet at which outlet primary combustion of the air-fuel mixture takes place, means extending to adjacent said outlet means for supplying supplementary air for combustion with the products of said primary combustion, a plurality of guide elements located in the passage in positions angularly spaced about the central axis of the passage, said guide elements extending along the passage at an oblique angle to the flow of the air-fuel mixture incident upon them, at or adjacent the outlet end of the passage a plurality of flow-disturbing members located in the passage in positions angularly spaced about said central axis, and spaced downstream from said guide elements, said flow-disturbing members having a relatively fine leading edge on which said flow impinges, and a transverse cross-sectional profile that thickens from said leading edge, and being arranged to modify the flow pattern of the air-fuel mixture at the passage outlet.

* * * * *